US007762010B2

(12) United States Patent
Sartor et al.

(10) Patent No.: US 7,762,010 B2
(45) Date of Patent: Jul. 27, 2010

(54) TOE FOR SAFETY FOOTWEAR HAVING A MULTILAYER STRUCTURE

(75) Inventors: Leo Sartor, Montebelluna (IT); Valter Bozzetto, Santa Lucia Di Piave (IT); Angelo Montemurro, Chiavenna (IT)

(73) Assignee: Novation Tech, S.p.A., Montebelluna (IT)

( * ) Notice: Subject to any disclaimer, the term of this patent is extended or adjusted under 35 U.S.C. 154(b) by 719 days.

(21) Appl. No.: 11/666,702

(22) PCT Filed: Oct. 21, 2005

(86) PCT No.: PCT/IT2005/000615

§ 371 (c)(1),
(2), (4) Date: Apr. 30, 2007

(87) PCT Pub. No.: WO2006/048909

PCT Pub. Date: May 11, 2006

(65) Prior Publication Data

US 2007/0289165 A1 Dec. 20, 2007

(30) Foreign Application Priority Data

Nov. 2, 2004 (IT) ..... PD2004A0269
Mar. 23, 2005 (EP) ..... 05006327

(51) Int. Cl.
*A43B 23/08* (2006.01)
*A43B 23/10* (2006.01)
*A43C 13/14* (2006.01)

(52) U.S. Cl. ..... 36/77 R; 36/77 M; 36/72 R

(58) Field of Classification Search ..... 36/77 R, 36/77 M, 72 R, 75 R, 96; 12/146 D
See application file for complete search history.

(56) References Cited

U.S. PATENT DOCUMENTS

| | | | | |
|---|---|---|---|---|
| 2,426,211 | A * | 8/1947 | Heckman | 36/4 |
| 2,740,209 | A * | 4/1956 | Shultz | 36/77 R |
| 3,034,235 | A * | 5/1962 | Hunting et al. | 36/77 R |
| 3,467,976 | A * | 9/1969 | Jonas | 12/146 C |
| 3,805,419 | A * | 4/1974 | White | 36/77 R |
| 6,029,373 | A * | 2/2000 | Diradour et al. | 36/12 |
| 6,412,195 | B1 | 7/2002 | Mack et al. | |
| 6,604,303 | B2 * | 8/2003 | Covatch | 36/77 R |
| 6,631,569 | B1 * | 10/2003 | Scharbius et al. | 36/72 R |
| 7,305,776 | B2 * | 12/2007 | Hess | 36/72 R |
| 2004/0139630 | A1 | 7/2004 | Gerwin | |
| 2005/0011086 | A1 * | 1/2005 | Goetze | 36/72 R |

(Continued)

FOREIGN PATENT DOCUMENTS

DE 203 16 229 3/2004

(Continued)

OTHER PUBLICATIONS

International Search Report for PCT/IT2005/000615, dated Feb. 14, 2006.

*Primary Examiner*—Ted Kavanaugh
(74) *Attorney, Agent, or Firm*—RatnerPrestia

(57) ABSTRACT

A toe for safety footwear, including a shell shaped so as to receive the extremity of a foot placed in the footwear, and a lining which is structurally separate from the shell and shaped in such a way as to match its profile. The lining is also bonded to an outer surface of the shell, at least partly covering it.

9 Claims, 1 Drawing Sheet

U.S. PATENT DOCUMENTS

| | | | | |
|---|---|---|---|---|
| 2006/0070262 | A1 * | 4/2006 | Shaw et al. | 36/77 R |
| 2008/0163519 | A1 * | 7/2008 | Sartor et al. | 36/77 M |

FOREIGN PATENT DOCUMENTS

| | | |
|---|---|---|
| GB | 794 969 | 5/1958 |
| WO | WO 97/19609 | 6/1997 |
| WO | WO 01/51263 | 7/2001 |

* cited by examiner

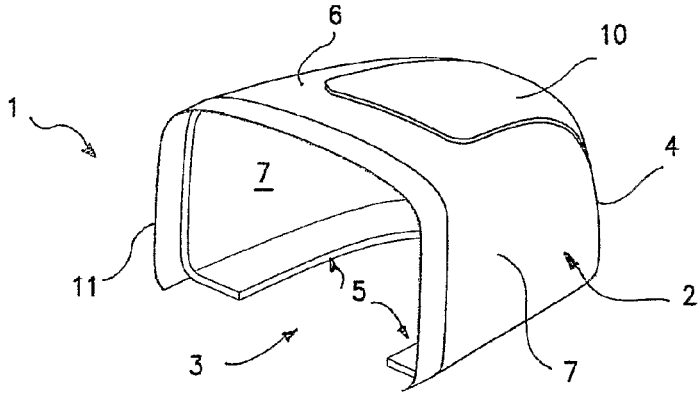
Fig. 1
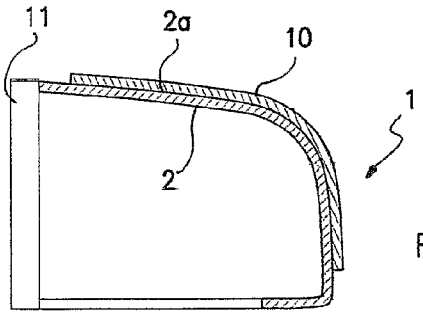
Fig. 2
Fig. 3
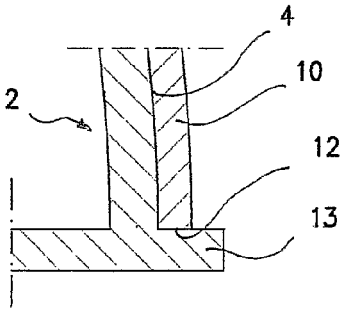
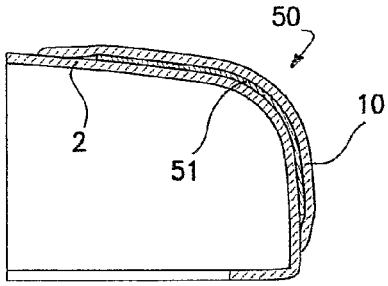
Fig. 4
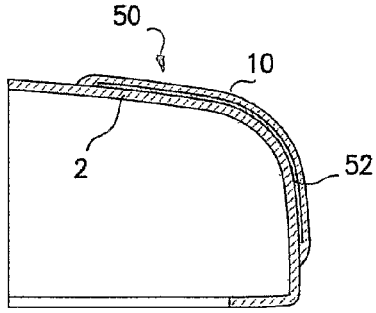
Fig. 5
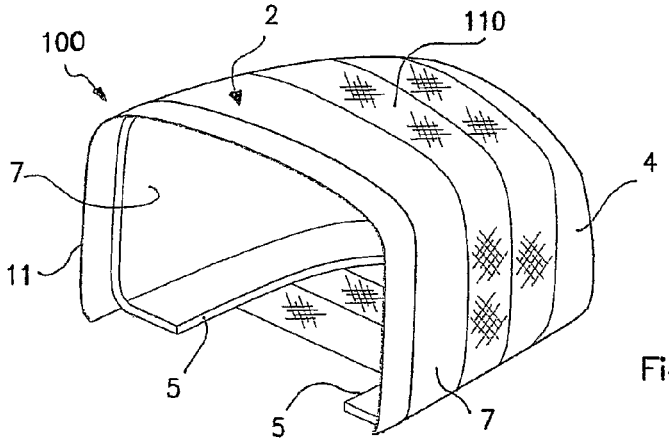
Fig. 6

TOE FOR SAFETY FOOTWEAR HAVING A MULTILAYER STRUCTURE

This application is a U.S. National Phase Application of PCT International Application PCT/IT2005/000615 which is incorporated by reference herein.

TECHNICAL FIELD

This invention relates to a toe for safety footwear, and more particularly to a toe having a multilayer structure.

BACKGROUND OF INVENTION

In the technical field to which the invention relates it is known that footwear known as safety footwear can be reinforced with suitable toes so that such footwear is sufficiently structured to protect the end of the foot from any impacts due to heavy objects falling onto them.

Known toes are typically made of metal, plastics material or composite material. Each of these types has some disadvantages brought about by the characteristics of the basic material. It is in fact known that metal toes are generally heavy and are unsuitable for use where temperatures are relatively high or, conversely, relatively low, and in places subjected to monitoring by metal detectors. On the other hand toes of plastics material generally have great thicknesses, compensating for their not exceptional mechanical strength properties, and are thus bulky and not very comfortable to use. Finally toes of composite material have the limitation of a high production cost.

There are also toes of plastics material in which a metal core is embedded. This structure may however prove to be not very effective in some cases in that following an impact the metal core can crack or cut the body of plastics material in which it is embedded. In order to restrict the possibilities in which this undesirable eventuality may occur, the metal core must therefore first be machined to round its edges.

BRIEF DESCRIPTION OF THE INVENTION

The toe for safety footwear, of the present invention is structurally and functionally designed to overcome the limitations mentioned above with reference to the cited prior art.

In the context of this problem one object of the invention is to provide a toe with improved impact strength properties, having reduced thickness and weight and low production costs.

This problem is solved and this object is accomplished by this invention through a toe for safety footwear having a shell shaped in such a way as to receive the extremity of a foot placed in the footwear, a lining which is structurally separate from the shell and shaped in such a way as to match the profile of the shell, the lining being integrally bonded to an outer surface of the shell and at least partly covering the same, and a layer of elastomer or viscoelastic material having a thickness of between 0.3 and 2.5 mm placed between the shell and the lining.

BRIEF DESCRIPTION OF THE DRAWINGS

Other advantages and characteristics of the present invention will become clear from the following detailed description which is given with reference to the appended drawings which are provided purely by way of non-limiting example and in which:

FIG. 1 is a perspective view of a first embodiment of a toe according to this invention, FIG. 2 is a view in longitudinal cross-section of the toe in FIG. 1, FIG. 3 is a view in longitudinal cross-section of a variant embodiment of the toe in FIG. 1, FIG. 4 is a view in longitudinal cross-section of a second embodiment of a toe according to this invention, FIG. 5 is a view in longitudinal cross-section of a variant embodiment of the toe in FIG. 4, FIG. 6 is a perspective view of a third embodiment of a toe according to this invention.

PREFERRED EMBODIMENTS OF THE INVENTION

Initially with reference to FIGS. 1 and 2, 1 indicates as a whole a toe for safety footwear manufactured according to this invention.

Toe 1 comprises a shell 2, conventionally shaped in such a way as to be housed in the toe portion of a shoe (not shown) supporting and reinforcing the same.

Specifically with reference to the positioning of toe 1 within the safety shoe in which it is intended to be housed, there are defined in shell 2 an opening 3 to allow the toe of the user's foot to be inserted, a front portion 4 which closes off the toe on the side opposite opening 3, a base 5 supported on the sole of the shoe, a dorsal portion 6 opposite base 5 and at a distance from the sole, and a pair of sides 7 extending between base 5 and dorsal portion 6 at the sides of front portion 4.

Shell 2 is preferably made of plastics material, for example by the injection and molding of a polyolefin, polyamide or polycarbonate-based polymer mixture.

A lining 10 shaped so as to match the outer profile of shell 2 and at least partly cover outer surface 2*a* thereof is integrally bonded to shell 2.

Preferably lining 10 is shaped so as to cover front portion 4 and dorsal portion 6 when applied to shell 2.

Lining 10 is made of a material having good toughness characteristics so as to withstand impacts, deforming without breaking, and is preferably made of plastics material or metal.

In the former case lining 10 may be conveniently manufactured from a polymer mixture based on polyamide, ABS, polycarbonate, etc.

In the latter case lining 10 may be conveniently made of a sheet of mild steel or a sheet based on titanium alloy. In this last case the toe obtained is as a whole much lighter for the same thickness and/or mechanical properties.

Lining 10 is bonded to shell 2 by adhesive bonding over the entire contact surface or by other techniques suitable for the purpose.

The thickness of lining 10 in either case is strictly dependent on the thickness and material of shell 2, and this indicatively lies between 1 and 4 mm when made of plastics material and between 0.2 and 1 mm when made of metal.

Preferably toe 1 also comprises an end portion 11 bonded (for example by injection overmolding) to shell 2 at the edge defining opening 3 and projecting there from along frontal portion 4.

End portion 11 offers greater wearing comfort for the user and is in fact made of soft material, for example rubber, so as to be easily deformable if there is contact between the toe and the top of the foot when walking.

In a variant embodiment of the invention, shell 2 is made of metal material.

According to another variant embodiment of the invention illustrated in FIG. 3, lining 10 is supported at its lower edge 12 on a plinth 13 which extends and projects from the edge of base 5 of shell 2.

Tests carried out by the Applicant have shown that with this structural configuration the toe offers greater resistance to impacts, all the other characteristics being the same. It is likely that this is due to the fact that a significant component of the stresses deriving from the impact with a heavy falling object is discharged by lining 10 directly onto base 5 of shell 2, and therefore under normal operating conditions these are transmitted to the underlying sole.

In a second embodiment, indicated as a whole in FIG. 4 by a toe 50, in which details which are similar to the previous example are indicated by the same reference numbers, a layer 51 of viscoelastic or elastomer material, such as for example vulcanised rubber or silicone rubber, is placed between shell 2 and lining 10.

This layer has a thickness of between 0.3 and 2.5 mm, preferably between 0.5 and 1.5 mm.

A particularly preferred material for this purpose is made of silicone.

In a variant embodiment of toe 50, diagrammatically illustrated in FIG. 5, it is provided that a layer 52 of tear-resistant and substantially non-stretching material 52, by which term are meant materials having very high elastic modulus and ultimate tensile strength values together with optimum deformation capability and impact resistance, are placed between shell 2 and lining 10.

A preferred example of a material which is useful for the purpose comprises an aramid fibre fabric known on the market by the name of Kevlar®.

Layer 52 is bonded to shell 2 and lining 10, for example by adhesive bonding.

According to another embodiment of the invention, the aramid fibre fabric is bonded to lining 10 on the opposite side of shell 2.

Toes made according to this invention and toes made according to the prior art were subjected to impact strength tests according to standard ISO 20345/2003. These tests substantially comprise causing a weight of approximately 20 kg of predetermined shape to fall by a corner onto the upper dorsal surface of the toe from a height of 1 meter.

The test is satisfied when the deformation deriving from the impact is less than a predetermined amount and no significant cracking is associated with it.

The test revealed how a comparison toe obtained conventionally and having a single layer of polycarbonate plastics material required a thickness of at least 7 mm in the dorsal part in order to pass the abovementioned test.

Conversely the test was satisfactorily passed by the toes described below, all of which were manufactured according to this invention.

The first of these toes comprised a shell having a thickness of approximately 2 mm in the dorsal part to which was bonded a lining approximately 2 mm thick and between which there was placed a layer of approximately 1 mm of silicone rubber. Both the toe and the lining were manufactured of the same plastics material of which the comparison toe was made.

The second toe tested comprised a shell of plastics material similar to the above, to which was bonded a sheet of mild steel of approximately 0.5 mm and between which was placed a layer of aramid fibre fabric (Kevlar®) adhesive bonded to both the shell and the lining.

The third toe tested was similar to that in the preceding example, in which the layer of Kevlar® was bonded onto the steel lining, as a result of which the layers in the toe were, in order from the outside towards the inside, one layer of polycarbonate (2 mm), one of steel (0.5 mm) and one of Kevlar®.

A comparison between the results obtained shows that the toes according to the invention require an overall thickness which is very much less than similar toes manufactured in accordance with the prior art.

Not only this, measurement of the deformation deriving from the impact demonstrated that all three toes tested had an impact strength approximately 10-15% greater than that of the comparison toe.

Without wishing to be bound by any specific theory, it is reasonable to attribute the advantageous effects shown by the tests performed to the fact that, in the case of the toe with the viscoelastic or elastomer layer, in addition to being partly absorbed by layer 51, the stresses and the deformations deriving from the fall of a weight onto lining 10 are transmitted to shell 2 beneath over a wider surface area, so that any deformation brought about in the shell is more contained.

Conversely in the case of toes having a layer of aramid fibre fabric, it is instead reasonable to suppose that localised deformation of shell 2 and/or lining 10 is translated into a tensile load on the fabric between the deformed zone and the un- (or less) deformed zone and a shear force between the fabric itself and the surface of the shell or lining in contact with the fabric. These loads are however respectively opposed by the tensile strength and very small percentage elongation characteristic of aramid fibres and the bonding force between the fabric and the shell and/or the fabric and the lining.

It will be noted therefore that in both cases the overall general effect is that of distributing the stresses deriving from the impact, which are in themselves extremely localised, over a very much greater surface area so that they can be opposed more effectively.

FIG. 6 indicates as a whole by 100 a toe representing a third embodiment of this invention, in which details similar to the toes described in the preceding examples are indicated by the same reference numbers.

Toe 100 comprises a shell 2 and a lining 110 comprising a fabric made of a tear-resistant and substantially non-stretching material such as for example Kevlar®.

Lining 110 is advantageously closed into a ring about shell 2 in such a way as to drape over sides 7, dorsal part 6 and base 5 without any break in continuity.

When subjected to the impact strength tests described above, toe 100 performed very satisfactorily and substantially better than a similar toe in which the Kevlar® only covered a portion of the shell without forming a closed ring around it.

Very likely the structure of toe 100 makes it possible to effectively contain the deformations induced in the shell by the impact with the falling weight, and in particular the deformation which normally takes place along sides 7, which tends to spread them with respect to base 5, is well contained.

This embodiment of the invention is particularly advantageous in order to significantly improve the performance of toes whose base 5 has a wide opening at the bottom, such as that illustrated in FIG. 6.

It should however be emphasised that most toes in commerce have such a conformation at the base.

Obviously it is also provided that lining 110 may be further covered in frontal part 4 and/or dorsal part 6 of shell 2 by a second lining of plastics material or metal material as described in the preceding embodiments.

In a variant of this latter embodiment it is provided that the Kevlar® fabric bonded to shell 2 extends between opposing sides 7 of shell 2, passing around the base of the toe without however surrounding it completely.

Finally it will be noted that the toes described above in the various embodiments of the invention may be marketed as finished toes or may be supplied as separate elements for assembly in different combinations according to the specific application of the footwear.

Advantageously this makes it possible for the manufacturers of safety footwear, who in general are not the same as the manufacturers of the toes, to personalise footwear with the most suitable toe in the most extensive way possible. It is therefore envisaged that suitable kits comprising one or more toes, one or more linings and, possibly, one or more portions of viscoelastic or elastomer material or aramid fibre fabric may be provided.

This invention therefore overcomes the problem complained of above with reference to the cited prior art, while at the same time offering many other advantages.

The invention claimed is:

1. A toe for safety footwear, comprising a shell shaped in such a way as to receive the extremity of a foot placed in the footwear, a lining which is structurally separate from the shell and shaped in a such a way as to match the profile of the shell, the lining being integrally bonded to an outer surface of the shell and at least partly covering the same, and a layer of elastomer or viscoelastic material having a thickness of between 0.3 and 2.5 mm placed between the shell and the lining.

2. The toe according to claim 1, in which the lining is made of plastic material.

3. The toe according to claim 1, in which the lining is made of metal.

4. The toe according to claim 3, in which the lining is made of steel or titanium alloy.

5. The toe according to claim 1, in which a plinth supporting the lining extends from a base of the shell.

6. The toe according to claim 1, in which the layer is made of silicone.

7. The toe according to claim 1, in which the shell is made of plastic material.

8. The toe according to claim 1, in which the shell is made of metal.

9. A kit for the manufacture of a toe for safety footwear, comprising at least one shell and at least one lining, which are separate from each other, and which are capable of being bonded together to give rise to a toe, and at least one portion of a viscoelastic or elastomer material further provided to form a toe according to claim 1.

* * * * *